US011020923B2

(12) United States Patent
Hyde

(10) Patent No.: US 11,020,923 B2
(45) Date of Patent: Jun. 1, 2021

(54) PORTABLE ELECTRO-PNEUMATIC ALUMINUM BEVERAGE CAN CRUSHER

(71) Applicant: Gary Alexander Hyde, Athens, AL (US)

(72) Inventor: Gary Alexander Hyde, Athens, AL (US)

( * ) Notice: Subject to any disclaimer, the term of this patent is extended or adjusted under 35 U.S.C. 154(b) by 277 days.

(21) Appl. No.: 16/397,102

(22) Filed: Apr. 29, 2019

(65) Prior Publication Data

US 2020/0338848 A1 Oct. 29, 2020

(51) Int. Cl.

| | |
|---|---|
| ***B30B 1/38*** | (2006.01) |
| ***B30B 15/32*** | (2006.01) |
| ***B30B 15/16*** | (2006.01) |
| ***B30B 15/00*** | (2006.01) |

(52) U.S. Cl.

CPC ..... *B30B 1/38* (2013.01); *B30B 15/0052* (2013.01); *B30B 15/166* (2013.01); *B30B 15/32* (2013.01)

(58) Field of Classification Search

CPC ..... B30B 1/38; B30B 15/0052; B30B 15/166; B30B 15/32; B30B 9/32; B30B 15/16; B30B 9/3021; B30B 15/26; B30B 9/3014; B30B 9/321; F16P 3/003; F16P 3/18; F16P 3/20; F16P 3/22; F16P 3/24

USPC ..... 100/218, 214, 226, 902, 295, 341, 343, 100/344, 347

See application file for complete search history.

(56) References Cited

U.S. PATENT DOCUMENTS

| | | | | | |
|---|---|---|---|---|---|
| 2,984,172 | A * | 5/1961 | Roberts | B65B 27/12 | 100/90 |
| 3,695,172 | A * | 10/1972 | Cleary | B30B 9/3017 | 100/45 |
| 5,287,803 | A * | 2/1994 | Cole | B30B 9/321 | 100/215 |
| 5,303,643 | A * | 4/1994 | Fisher | B30B 9/06 | 100/125 |
| 5,381,732 | A * | 1/1995 | Trout | B30B 9/321 | 100/215 |
| 5,383,397 | A * | 1/1995 | Battles | B30B 1/003 | 100/125 |
| 5,566,610 | A * | 10/1996 | Robinson | B30B 9/3003 | 100/98 R |
| 5,678,478 | A * | 10/1997 | Goyal | B30B 9/321 | 100/52 |
| 6,006,660 | A * | 12/1999 | Bornhorst | F16D 13/64 | 100/282 |
| 7,806,047 | B1 * | 10/2010 | Gomez | B30B 9/321 | 100/216 |

(Continued)

*Primary Examiner* — Justin M Jonaitis

(57) ABSTRACT

An apparatus for crushing aluminum beverage cans, including; a containment structure with an integral crushing chamber, a pneumatic crushing cylinder with a hub type crushing head which ensures the can remains inside the crushing chamber during the crushing event, an ejection cylinder with an ejection ram, solenoid control valves, a safety interlock switch and a 3 position control switch, an air/gas supply and distribution system and an electrical control system. Two pneumatic cylinders; which are supplied air via two 3-way solenoid control valves, are used to perform the crushing and ejection work. Simultaneous two handed switch operation is required to energize either of the 3-way solenoid control valves to route air to the pneumatic cylinders. Two handed switch operation ensures that the operator's hands are free of the crushing chamber during operation.

15 Claims, 12 Drawing Sheets

(56) References Cited

U.S. PATENT DOCUMENTS

| | | | | |
|---|---|---|---|---|
| 8,122,824 | B1 * | 2/2012 | Pendleton | B30B 9/3007 100/245 |
| 8,479,647 | B1 * | 7/2013 | Gomez | B30B 9/321 100/35 |
| 2016/0257088 | A1 * | 9/2016 | Algea | B30B 15/165 |

* cited by examiner

| Contact Closure Sequence - 3-Postion Switch | | | | | |
|---|---|---|---|---|---|
| Contact Blocks | Contact Arrangement | | Switch Position | | |
| | Left | Right | Left (Note 1) | Center (Note 2) | Right (Note 3) |
| 2 X NO | NO | NO | X | | X |
| Note 1: Left switch position activates left side contacts<br>Note 2: Center switch position deactivates all contacts<br>Note 3: Right switch position activates right side contacts | | | | | |

PORTABLE ELECTRO-PNEUMATIC ALUMINUM BEVERAGE CAN CRUSHER

CROSS-REFERENCE TO RELATED APPLICATIONS

N/A

STATEMENT REGARDING FEDERALLY SPONSORED RESEARCH OR DEVELOPMENT (IF APPLICABLE)

N/A

REFERENCE TO SEQUENCE LISTING, A TABLE, OR A COMPUTER PROGRAM LISTING COMPACT DISC APPENDIX (IF APPLICABLE)

N/A

BACKGROUND OF THE INVENTION

This invention relates to lightweight aluminum soda/drink can crushing devices. There are many designs and patents for can crushers from manual lever operated to fully automatic electric, pneumatic, hydraulic and mechanical devices. Since the beginning of metal cans being produced it seems that man has been trying to reduce the size of the used cans to reduce their volume and waste profile.

Previous can crusher patents describe a broad spectrum of reasons for developing a can crusher. One of the leading reasons in numerous previous patents was the need to reduce the volume of the cans to a manageable size for storage and disposal and/or subsequent transportation to a recycle center. This invention was conceived by the inventor for the above stated reason. The inventor wanted to make the process of reducing the size of aluminum drink cans as easy as possible and fun. Typical small and medium aluminum soda and beer cans are manufactured with lightweight aluminum for the purpose of storing and dispersing liquids. Being a good steward of the earth the inventor doesn't believe in adding unnecessary waste to our landfills and therefore recycles his waste products as appropriate. Aluminum cans are one of the waste products that the inventor saves and recycles. The stated problem is that aluminum drink cans are relatively large compared to their weight (large volume to weight ratio) and saving them takes up considerable space over time. This invention is intended to solve the space problem, both in storage and transportation by crushing the cans to a manageable size, while reducing the physical work required to crush cans and being fun to operate. As pointed out in several previous patents many recycle centers pay the going market rate for aluminum cans, therefore the invention can pay for itself over time.

At the time this invention was conceived the inventor did a market search to see what was available for the home consumer to purchase. The inventor found that there were primarily only manually operated lever type can crushers on the market for the home consumer which is the demographics the inventor is initially interested in helping. As previously stated there are many designs and patents for can crushers from the manual lever operated to fully automatic electric, pneumatic, hydraulic and mechanical devices, but apparently very few are actually suitable for the home consumer, possibly due to the complexity, impracticality, cost of the invention, or any combination of reasons.

The lever operated can crushers currently on the market for the home consumer work fine but require a force applied by a person to crush the cans. Force applied equals work. The inventor wanted to reduce the work of hand crushing aluminum cans and thus went to work designing a home can crusher which would reduce the physical work of crushing aluminum cans and be fun and safe to operate.

This particular design was envisioned and built solely by the inventor after attempting other designs that seemed like good ideals but ended up just not being practical.

BRIEF SUMMARY OF THE INVENTION

This invention is designed to take nearly all of the physical work out of crushing typical aluminum drink cans via an electro-pneumatic system that applies simple engineering principles to achieve the desired outcome. The system uses pneumatics (air) to perform the actual work and electricity for control, and is light weight and portable. The invention is designed to crush small to medium aluminum drink cans inside of a containment structure using air pressure via a pneumatic air cylinder mounted to a containment structure and then eject the crushed can utilizing a pneumatic air cylinder. A hub type crushing head ensures the can stays inside the containment structure during the crushing process.

A prototype of a preferred embodiment has been built and tested to prove the design works as presented in this patent application. To date the prototype has crushed several thousand aluminum cans of various sizes without any component or structural failures. The prototype is built with off the shelf components for testing and development purposes. All components used in the design are readily available for purchase by the public. It is envisioned by the inventor that the final product would be of the same design but, several of the components could be made out of different materials as determined by the manufacturer.

The crushing components for the invention were selected based on requirements derived from tests performed by the inventor to determine the minimum required crushing force to reliably crush aluminum cans. The containment and crushing components were selected based on the requirements to safely contain the crushing process and to maintain containment integrity through the crushing process for the entire life cycle of the invention.

The invention requires a pneumatic (air/inert gas) supply at ~90-125 psi and an 110 VAC power supply. The invention will operate on 60 Hz US or 50 Hz European AC power.

BRIEF DESCRIPTION OF THE SEVERAL VIEWS OF THE DRAWINGS

The concept, design, use, and advantages of the invention will be presented in the detailed description and will become obvious when considered in connection with the accompanying drawings, wherein.

Figure 1:
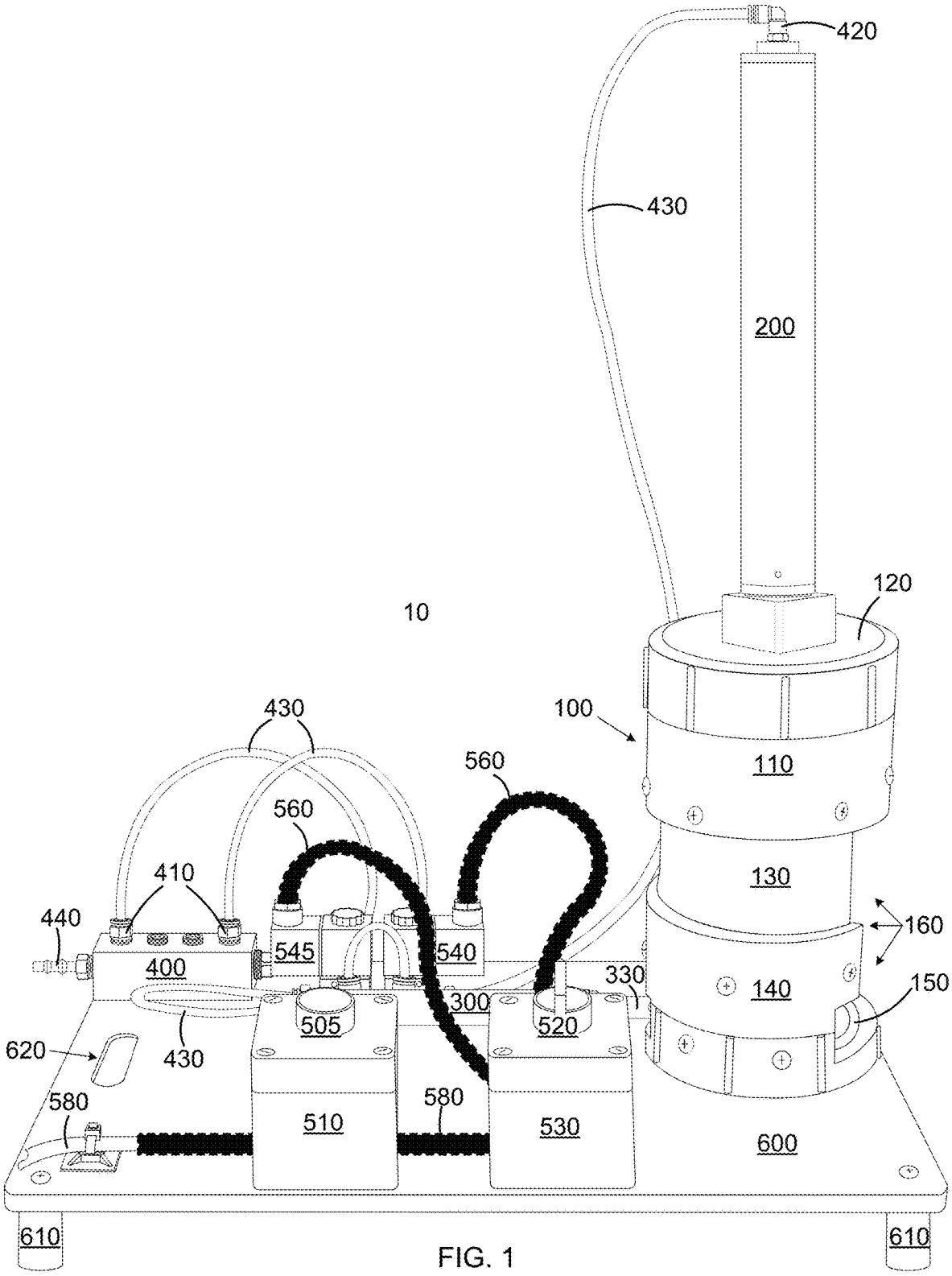
FIG. 1 is an elevated 3D isometric side view of an electro-pneumatic can crushing apparatus according to the present embodiment.

The following is a list of the elements referenced in the detailed description of the invention:

10. portable electro-pneumatic beverage can crusher
100. containment structure
110. upper containment
120. upper containment head
130. containment barrel
140. lower containment
150. lower containment floor/crushing base
160. crushing chamber
170. positioning spacers
200. crushing cylinder
202. crushing cylinder actuator piston
204. crushing cylinder actuator rod
206. crushing cylinder return spring
208. crushing cylinder vent hole
210. hub type crushing head
300. ejection cylinder
302. ejection cylinder actuator piston
304. ejection cylinder actuator rod
306. ejection cylinder return spring
308. ejection cylinder vent hole
310. ejection cylinder mounting base
320. ejection cylinder mounting bracket
330. ejection ram
340. ejection ram access opening
400. pneumatic manifold
410. male straight pneumatic push-to-connect fitting
420. male rotating elbow pneumatic push-to-connect fitting
430. poly tubing
440. quick disconnect 0.25 inch pneumatic supply nipple
500. control circuit
505. safety interlock push button
510. safety interlock push button enclosure
520. 3 position control switch
530. 3 position control switch enclosure
540. crushing cylinder 3-way solenoid control valve
545. ejection cylinder 3-way solenoid control valve
550. solenoid control valve mounting bracket
560. control wiring with plastic wire wrap
570. contactors
580. power cord/supply, with and without plastic wire wrap
585. adhesive wire retainer
600. operating platform
610. operating platform legs
620. carrying handle
700. aluminum can

DETAILED DESCRIPTION OF THE INVENTION

The detailed description with reference to the drawings in FIGS. 1 through 113 describes the embodiment of the invention 10 in precise terms and details, which will allow any skilled person in the art to reproduce the art and put it to use as intended.

An electro-pneumatic can crushing apparatus according to the present embodiment of the invention 10 has a vertically mounted cylindrical containment structure 100 with a pneumatic crushing cylinder 200 vertically mounted to an upper containment head 120. A hub type crushing head 210 is attached to the crushing cylinder actuator rod 204 which strokes vertically downward to crush aluminum cans 700 inside a crushing chamber 160 against a lower containment floor/crushing base 150. A pneumatic ejection cylinder 300 is horizontally mounted to an operating platform 600 to provide for ejection of a crushed can 700 from the crushing chamber 160 after the crushing event.

Figure 3:
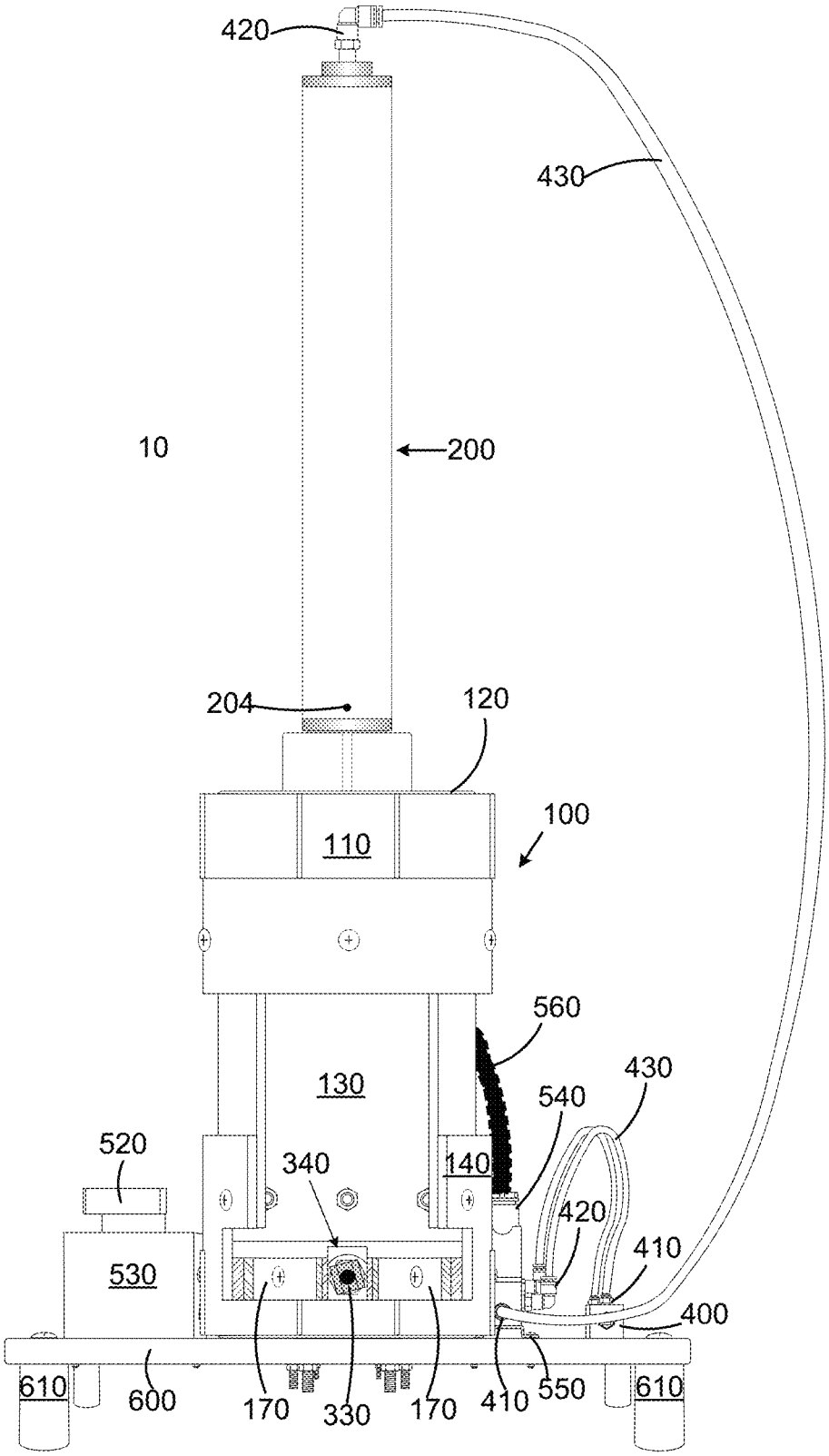
FIG. 3 is a front perspective view of an electro-pneumatic can crushing apparatus according to the present embodiment.
Figure 4:
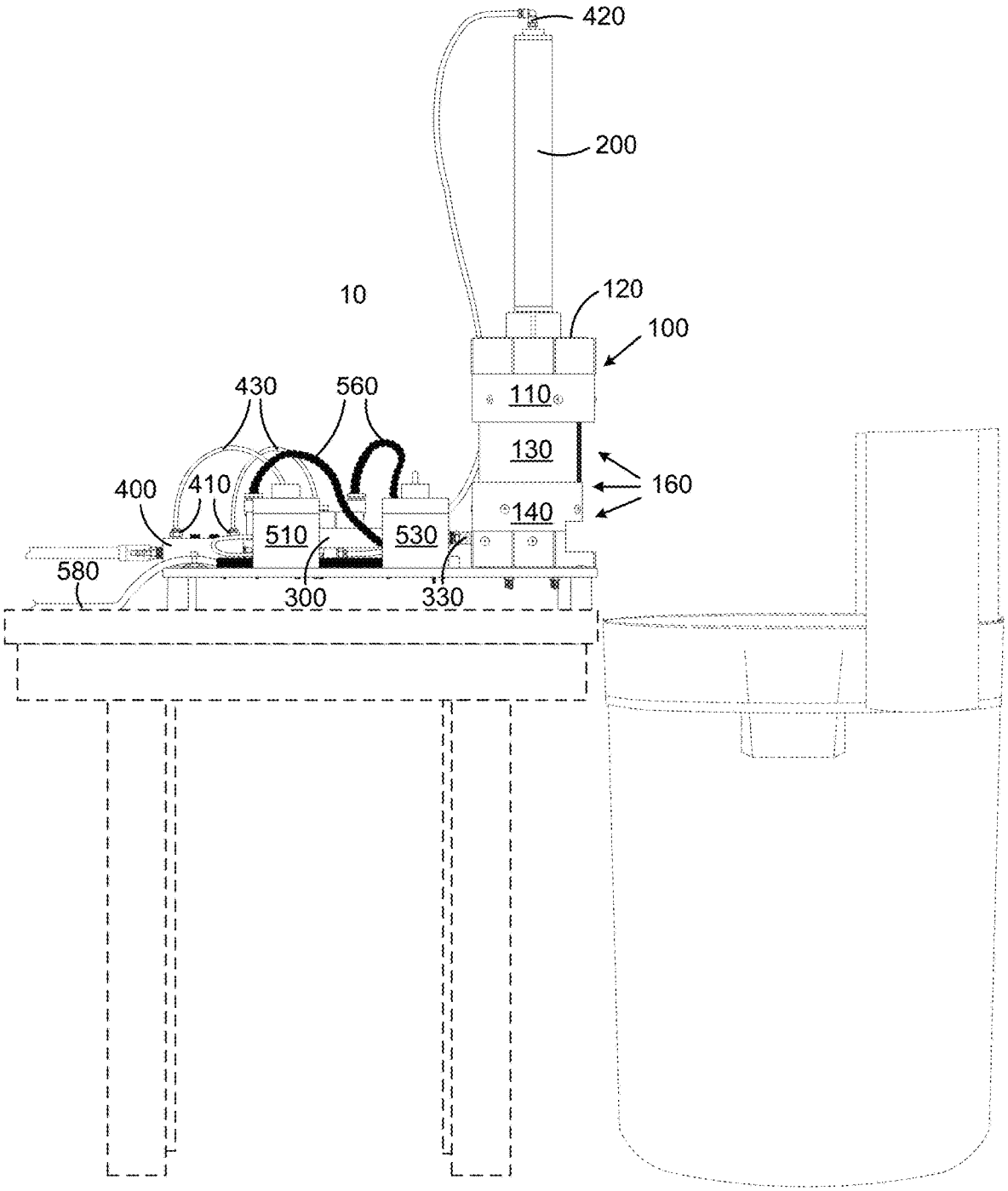
FIG. 4 is a side view of an electro-pneumatic can crushing apparatus in position ready to crush cans, according to the present embodiment.
Figure 5A:
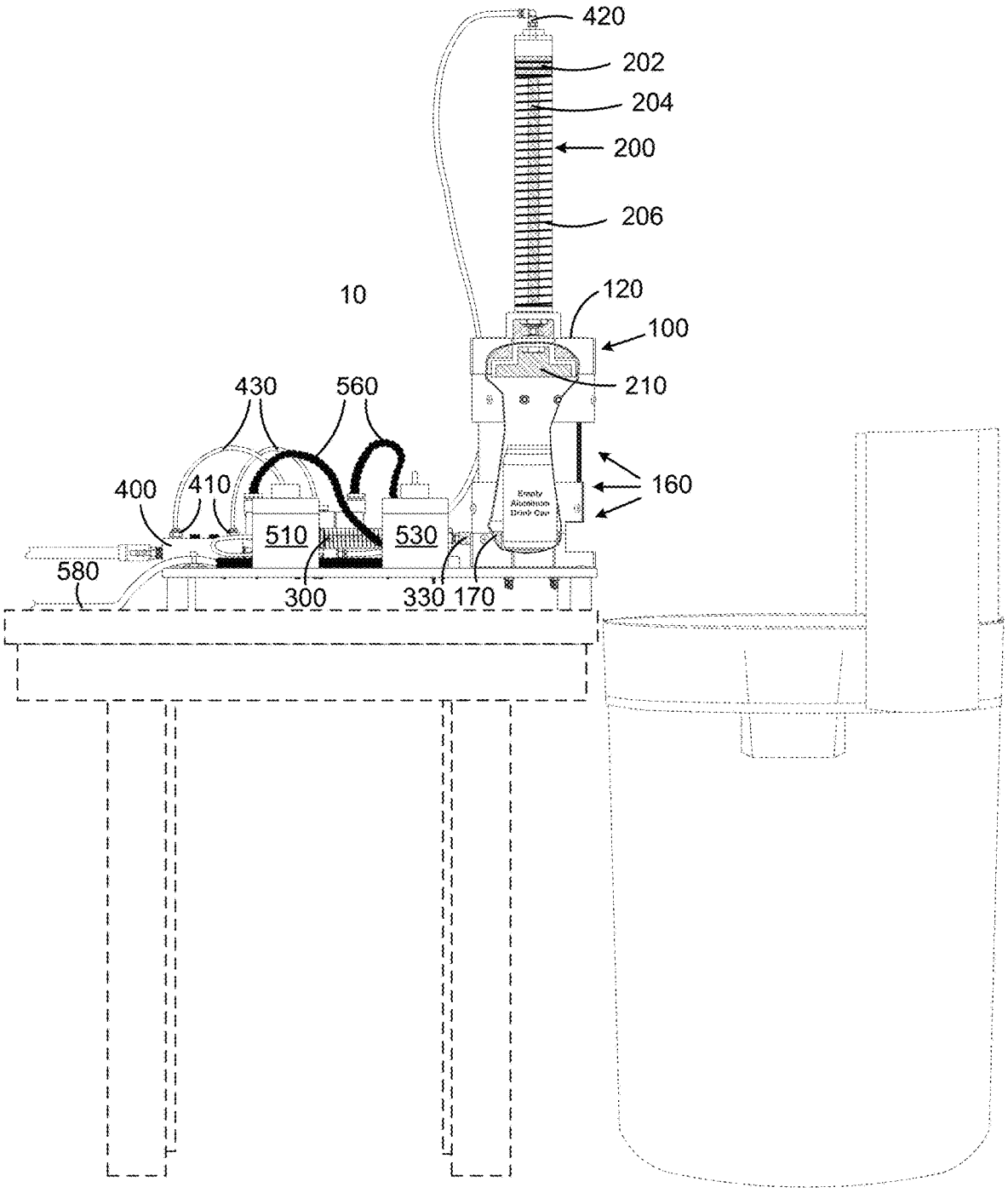
FIG. 5A-D are side views with a section of the containment outer wall cutout, and the pneumatic cylinders outer walls removed showing the crushing and ejection process of an electro-pneumatic can crushing apparatus according to the present embodiment.
Figure 5B:
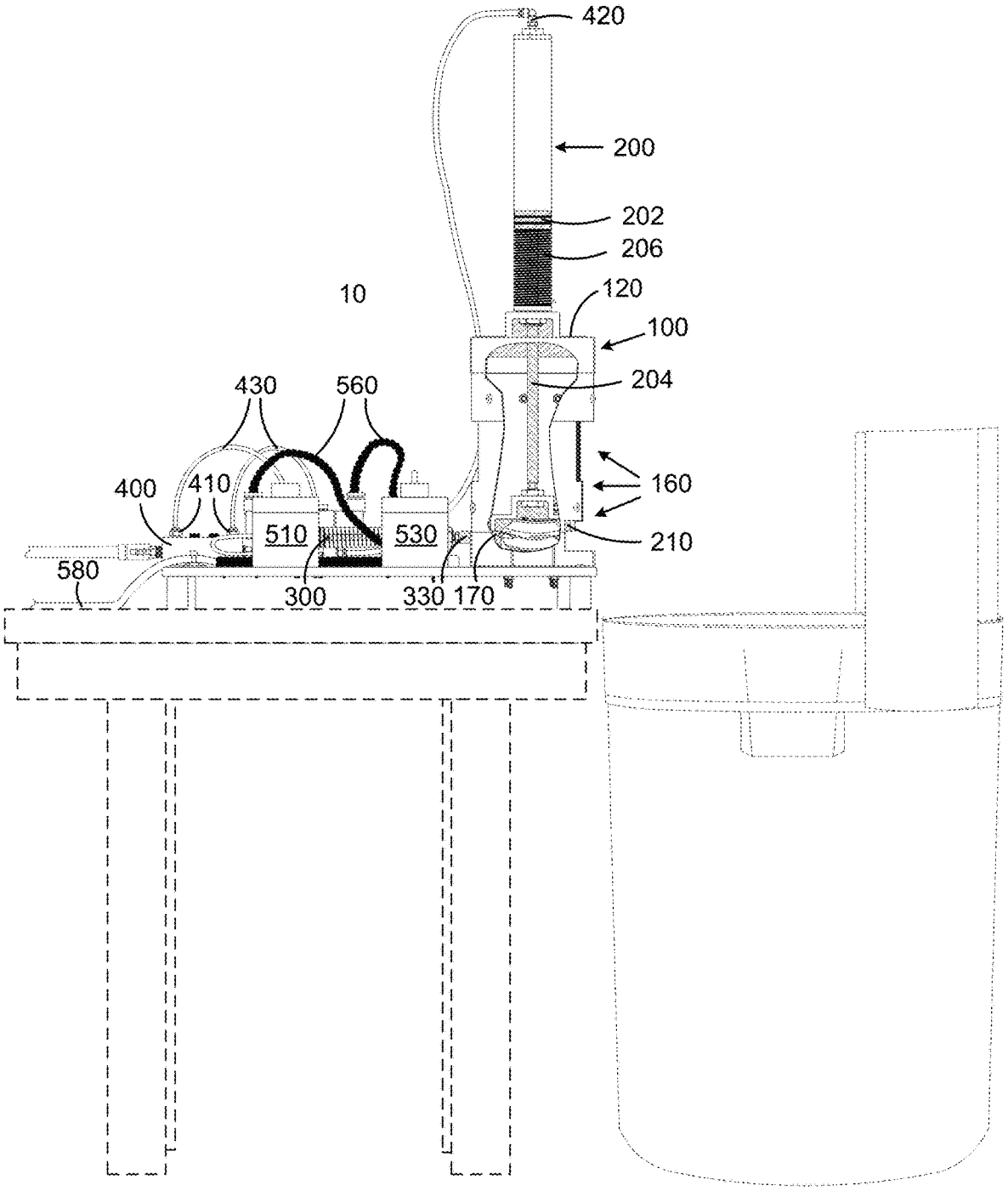
Figure 5C:
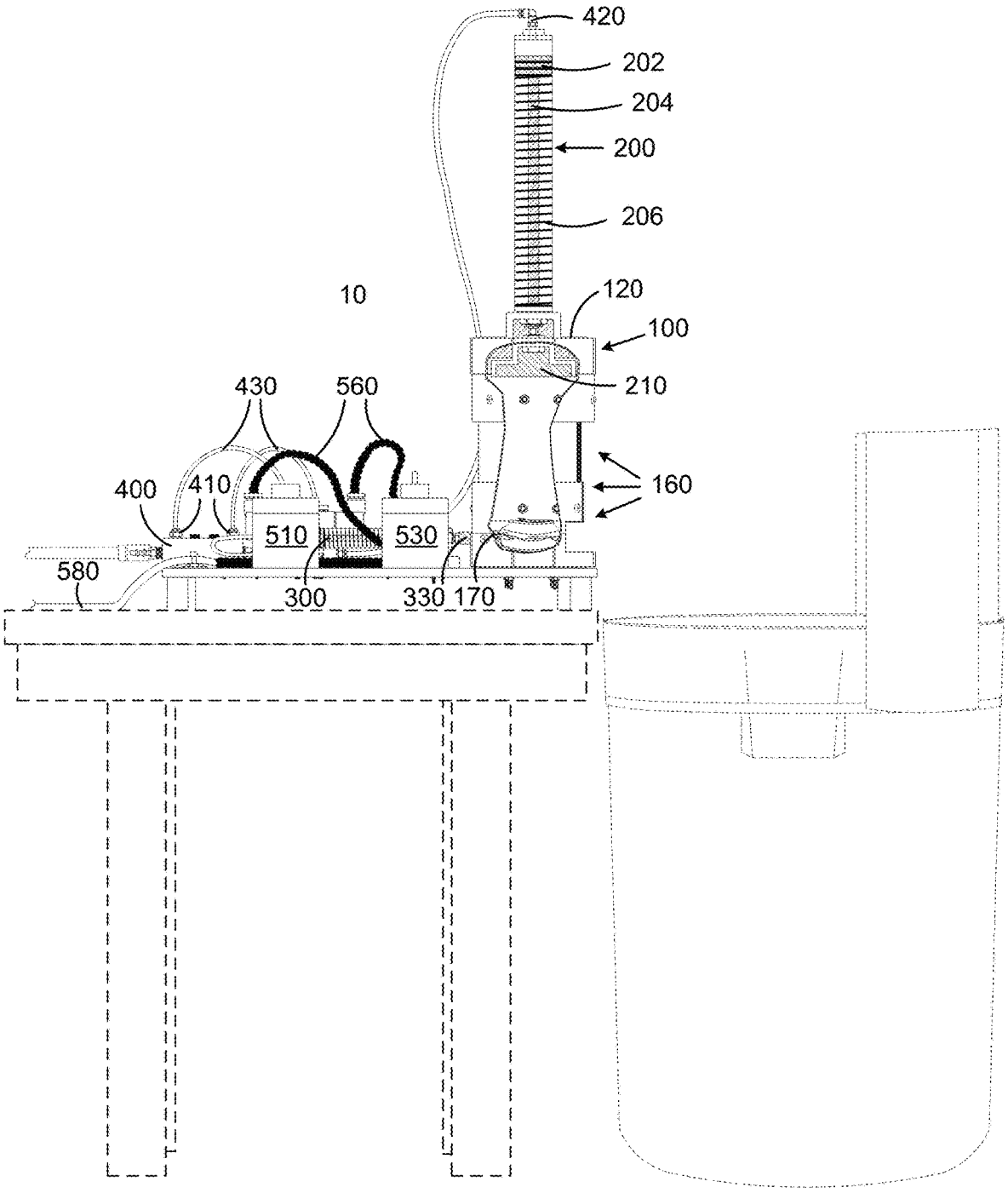
Figure 5D:
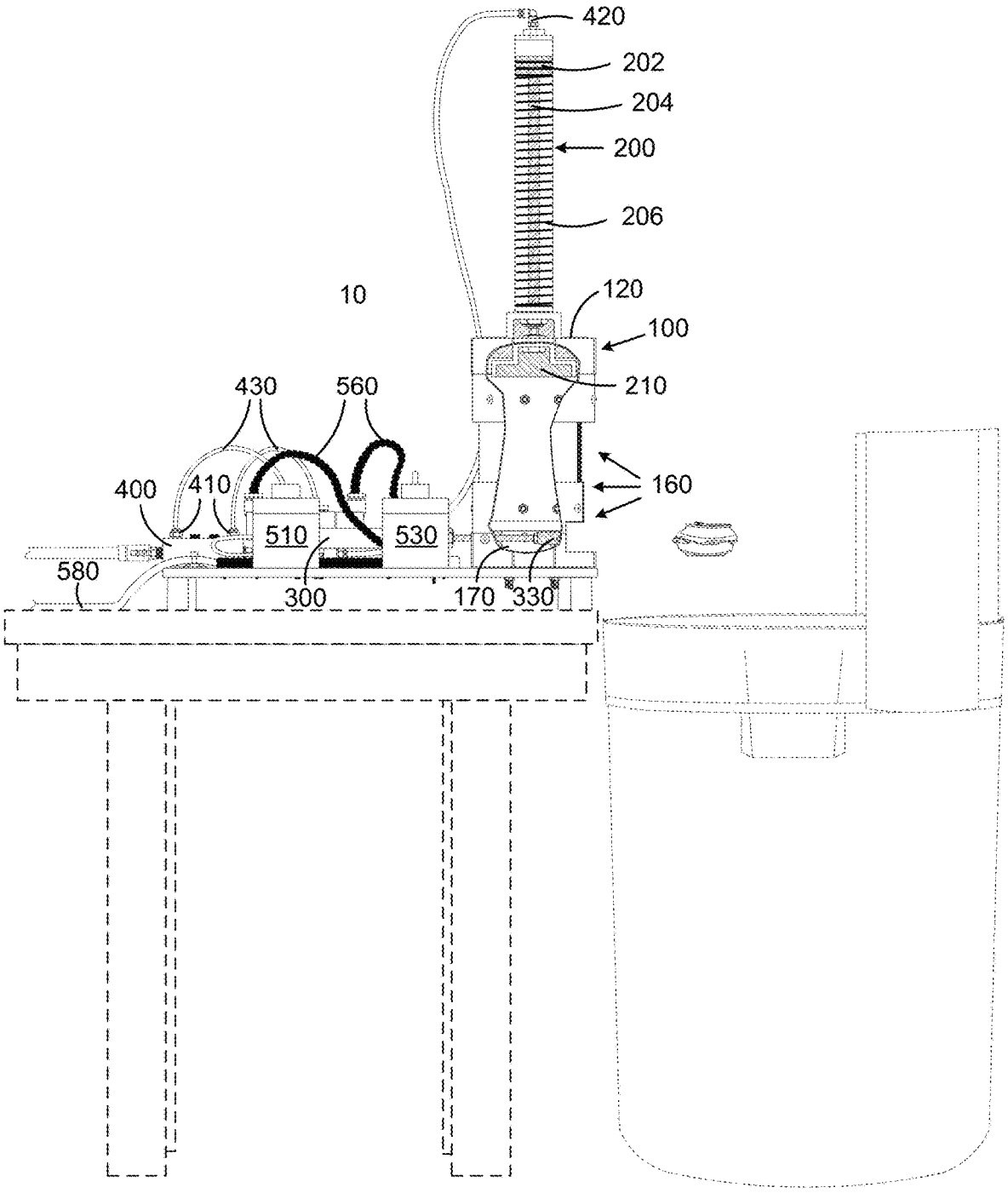
Figure 6A:
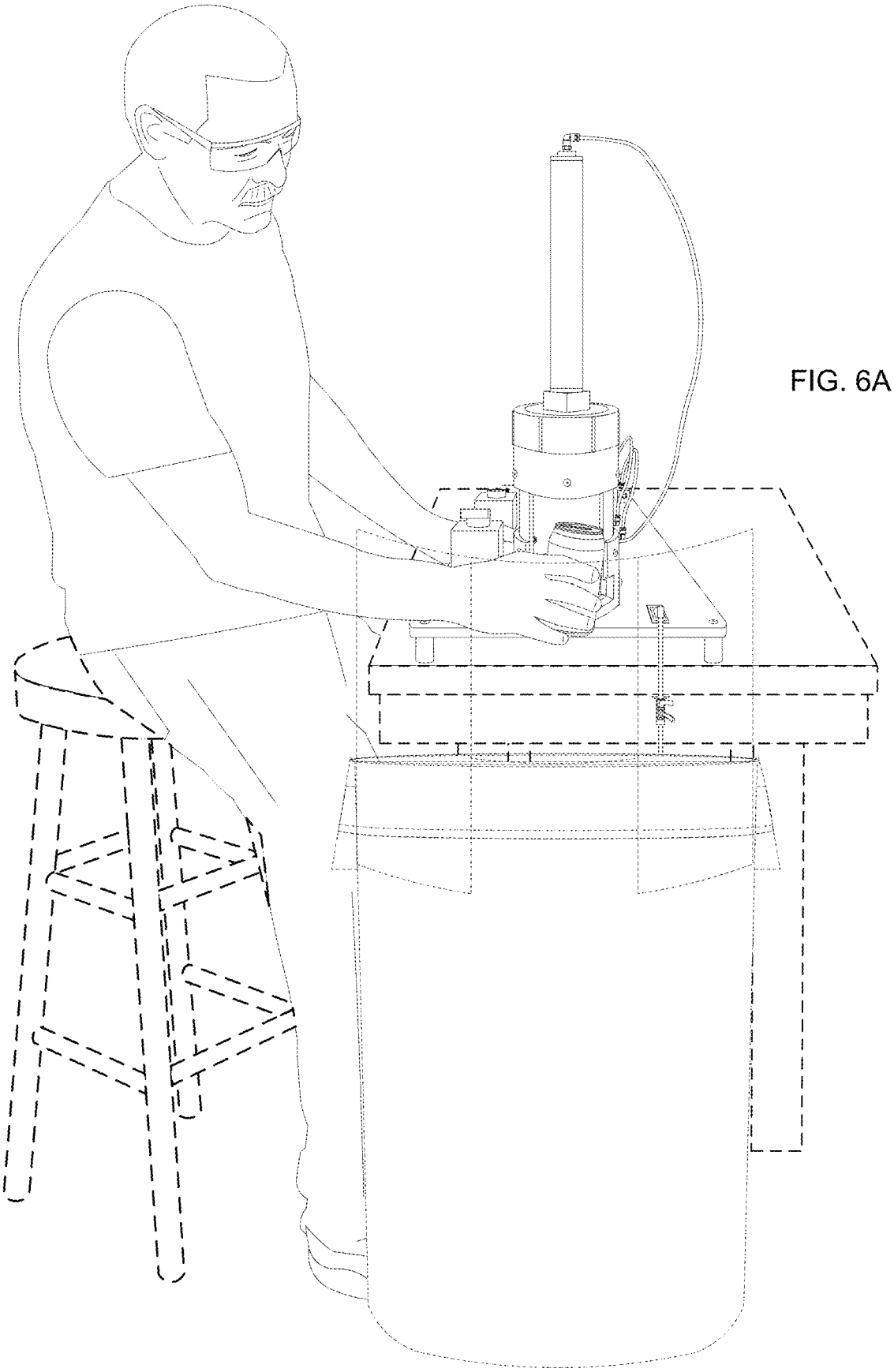
FIG. 6A-B are human interface front perspective views of loading and two handed operation of an electro-pneumatic can crushing apparatus according to the present embodiment.

As seen in FIG. 6A, Cans 700, are manually placed in the crushing chamber 160 of the containment structure 100. As seen in FIGS. 3, 5A, and 5B positioning spacers 170 are provided in the lower containment 140 peripheries and are sized to ensure that the cans 700 are properly positioned in the crushing chamber 160 to ensure the cans 700 are crushed by the internal crushing surface of the hub type crushing head 210 i.e. proper positioning as afforded by the positioning spacers 170 ensures the hub type crushing head 210 hub envelops the upper portion of the can 700 during the crushing event. The positioning spacers 170 are inside the lower crushing chamber 160 on each side of the chamber. The positioning spacers 170 are sized not to interfere with the hub type crushing head 210 during the crushing event and are designed not to interfere with the ejection event. The prototype positioning spacers 170 are secured to the lower containment 140 walls with screws and glued.

The prototype cylindrical containment structure 100 is made out of six common off-the-shelf 4 inch PVC components and off-the-shelf hardware (nuts, bolts & screws.) As seen in FIGS. 1-5D, the containment structure 100 is comprised of; an upper containment 110, an upper containment head 120, a containment barrel 130, a lower containment 140, a lower containment floor/crushing base 150 and an integral crushing chamber 160. The containment structure 100, the integral crushing chamber 160 and the hub type crushing head 210 contain the aluminum can 700 during the crushing event. The containment structure 100 shall be made out of material that is robust enough to contain the crushing force of the invention 10 during operation and maintain its integrity during the life cycle of the invention 10. It is preferable that the containment structure 100 be made out of light weight material to aid in keeping the invention 10 a portable light weight apparatus. The crushing chamber 160 is the inside of the containment structure 100 where the aluminum cans 700 are placed to be crushed. The crushing chamber 160 is sized to accept various sizes of aluminum or light weight metal/tin cans up to approximately 7 inches in height and approximately 3.5 inches in diameter.

As seen in FIGS. 1-4, the prototype upper containment 110 and lower containment 140 components are 4 inch diameter PVC Schedule 40 Adapter Fittings. The prototype containment barrel 130 is made out of 4 inch diameter Schedule 40 Solidcore PVC DWV piping. The containment barrel fits inside the upper and lower containment 110 and 140 components. The upper containment 110 and lower containment 140 components and the containment barrel 130 are secured together with standard PVC glue and stainless steel screws and nuts. The lower containment floor/crushing base 150 must be robust, and when properly attached to the operating platform 600 must be able to hold up to the forces and stresses of crushing aluminum cans 700 over the life expectancy of the invention 10. The prototype lower containment floor/crushing base 150 is a PVC Schedule 40 flat threaded plug. The containment structure 100 is through wall mounted to the operating platform 600 via the lower containment floor/crushing base 150 with high strength stainless steel bolts/screws.

As seen in FIGS. 1-4, 7, and 8, the upper containment head 120 is the mounting point for the crushing cylinder 200 and is therefore an extremely important component due to the forces it is subjected to over the lifetime of the invention 10. Each crushing cycle of the invention 10 produces up to the maximum force that the crushing cylinder 200 can produce, which in this case is 170 lbs force at 100 psig supplied air pressure. The prototype upper containment head 120 is a threaded hub type PVC Schedule 40 Cleanout Plug Fitting with a square protrusion/nut. The upper containment head 120 is removable for maintenance purposes and is threaded into the upper containment 110 adapter fitting.

As seen in FIGS. 1-6B, the containment structure 100 and integral crushing chamber 160 have two openings; one combination manual feed and crushed aluminum can 700 ejection opening on the front, and one ejection ram access opening 340 on the rear. The openings are sized for their particular tasks. The combination manual feed and crushed aluminum can 700 ejection opening on the front is sized to provide access for manually loading the crushing chamber 160 with aluminum cans 700. The upper part of the crushing chamber 160 opening is sized to allow for loading up to ~20 oz aluminum cans 700. The lower part of the crushing chamber 160 opening is wider than the upper part of the opening and is sized to allow for ejection of the crushed cans. The ejection ram access opening 340 on the rear is sized to allow for the ejection ram 330 to extend and retract during the ejection process.

The crushing cylinder 200 performs the Crushing work for the invention 10. The crushing cylinder 200 was chosen based on five criteria; quality, crushing force, stroke length, air usage and price:

a. The inventor believes that using quality components assures a quality product.
b. The minimum crushing force requirement was based on empirical testing performed by the inventor which showed that the minimum force required to consistently crush small and medium aluminum cans 700 is approximately 160 lbs of force.
c. The stroke length was selected to allow crushing of small and medium sized typical ~2.5 inch by ~5 inch aluminum beer and soda cans. The inventor has found that cans up to 7 inches in height and inches 3.5 in diameter easily fit in the crushing chamber 160 and are usually within the design capabilities of the crushing cylinder 200.
d. A single acting spring return pneumatic air cylinder was chosen to reduce the air usage per cycle of the invention 10. Using a single acting pneumatic air cylinder as stated above reduces the air usage per cycle and therefore reduces the load on the air supply allowing for smaller air compressors to keep up with the invention 10 during operation and allows bottled compressed gas to last longer. Note: The inventor doesn't rule out future models employing the use of double acting pneumatic air cylinders due to their increased capabilities.
e. Individual component prices determine the marketability of the invention 10 therefore the inventor searched for quality components at a reasonable price and believes that is what he has accomplished.

Figure 7:
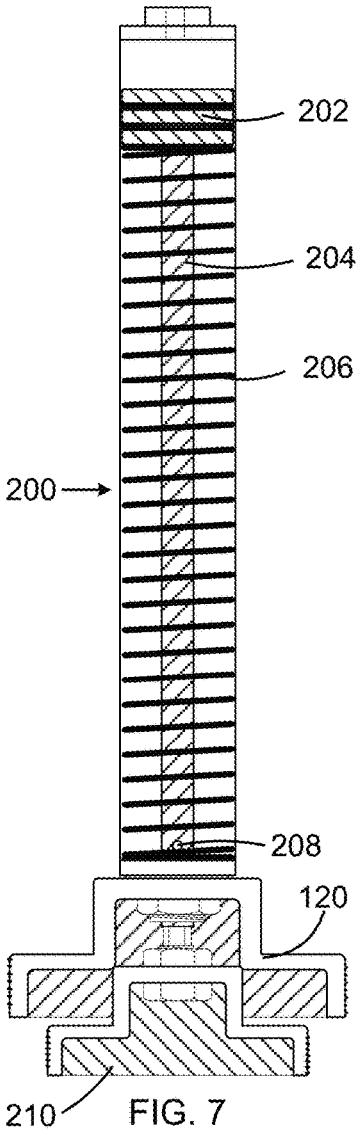
FIG. 7 is a cross sectional view of the crushing cylinder, containment head, and the hub type crushing head in the retracted position of an electro-pneumatic can crushing apparatus according to the present embodiment.
Figure 8:
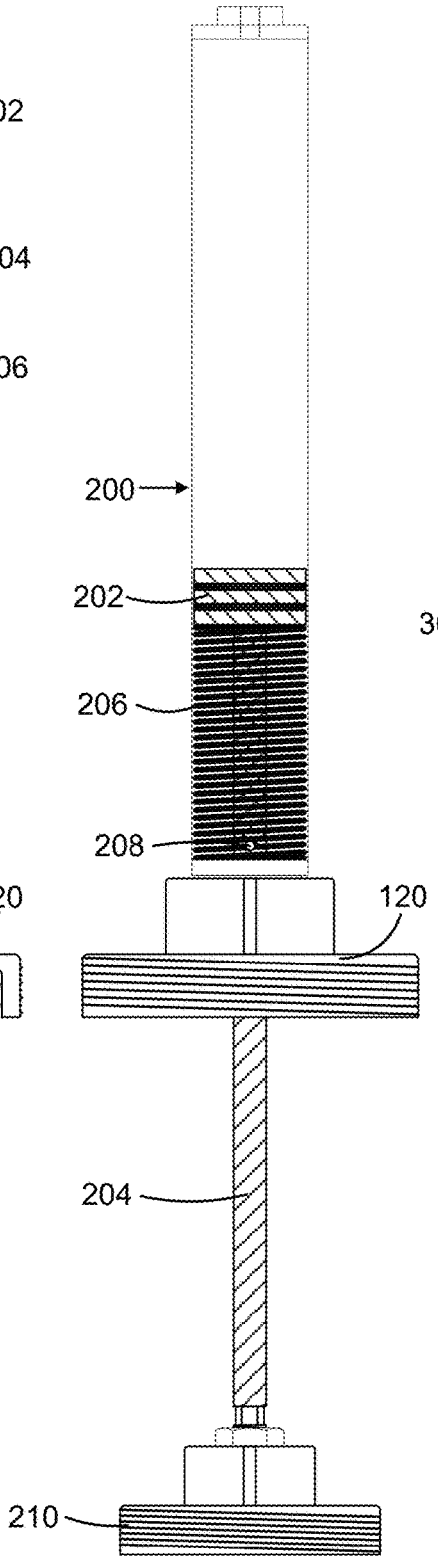
FIG. 8 is a cross sectional view of the crushing cylinder showing the hub type crushing head in the extended/crushing position of an electro-pneumatic can crushing apparatus according to the present embodiment.
Figure 9:
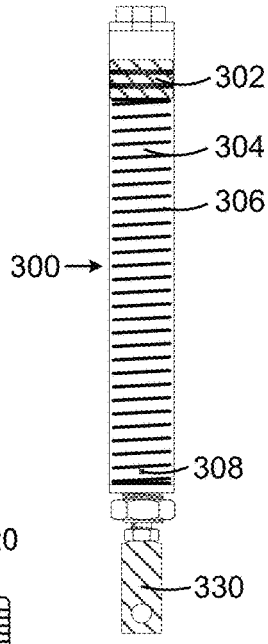
FIG. 9 is a cross sectional view of the ejection cylinder with the ejection ram in the retracted position of an electro-pneumatic can crushing apparatus according to the present embodiment.
Figure 10:
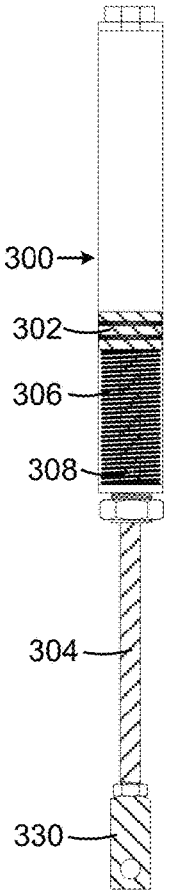
FIG. 10 is a cross sectional view of the ejection cylinder with the ejection ram in the extended/ejection position of an electro-pneumatic can crushing apparatus according to the present embodiment.

As seen in FIGS. 5A, 5B, 7, and 8, the crushing cylinder 200 is a single acting, front nose mount pneumatic air cylinder. The crushing cylinder 200 includes the; crushing cylinder actuator piston 202, crushing cylinder actuator rod 204, crushing cylinder return spring 204, crushing cylinder vent hole 208, and a female NPT air/gas port. The crushing cylinder 200 and associated components are designed for a maintenance free life and are made from high quality materials that are designed to withstand the rigors and stresses of the invention 10. As seen in FIG. 5B, the crushing cylinder actuator rod 204 stroke length must be long enough to allow the hub type crushing head 210 to adequately crush the aluminum cans 700 without impacting the positioning spacers 170 during the crushing event. As seen in FIG. 7, the crushing cylinder 200 is front nose mounted vertically to the upper containment head 120 via an appropriately sized hole in the square protrusion/nut. The nose of the crushing cylinder 200 is secured using an appropriately sized flat washer and mounting nut. The operating medium, air in this case is supplied to the crushing cylinder actuator piston 202 over piston area via the female NPT inlet port.

Referring to FIGS. 5A-5D, 7, and 8, the crushing cylinder 200 operating cycle uses Pneumatic principles; the application of compressed gas to produce mechanical motion. (Ref: http://www.rignitc.com/pneumatics-tutorial-1/.) Air is supplied at ~100 psig to the top of the crushing cylinder 200 via the female NPT port above the crushing cylinder actuator piston 202. The crushing cylinder actuator piston 202 converts the supplied air into linear work. Air is supplied to only one side of the crushing cylinder actuator piston 202 and the other side is open to the atmosphere via the crushing cylinder vent hole 208. When air is supplied at the required pressure to the actuator over piston area the actuator moves linearly against spring pressure compressing the crushing cylinder return spring 206 until the air supply is shutoff and vented off. While the actuator is moving in the direction of work the air in the actuator under piston area i.e. the crushing cylinder return spring 206 area is vented off via the crushing cylinder vent hole 208 while the crushing cylinder return spring 206 is being compressed. The size of the crushing cylinder actuator piston 202 determines the force that the actuator produces. The crushing cylinder actuator piston 202 is required to have a minimum of 1.7 sq. inch piston surface area to meet the design criteria of 170.0 lbs force at 100 psi air pressure.

As seen in FIGS. 5A-5D, 7, and 8, the prototype hub type crushing head 210 is a threaded hub type PVC Schedule 40 Cleanout Plug Fitting with a square protrusion/nut. The hub type crushing head 210 is sized to fit inside the upper containment head 120 when retracted and freely move up and down in the crushing chamber 160. The hub type crushing head 210 is attached to the crushing cylinder actuator rod 204 via the actuator rod end. An appropriate size hole is drilled in the hub type crushing head 210 protrusion and the threaded crushing cylinder actuator rod 204 rod end is inserted into the hub type crushing head 210. The hub type crushing head 210 is secured to the crushing cylinder actuator rod 204 with two mounting nuts. The hub on the hub type crushing head 210 ensures that the aluminum cans 700 stay in the crushing chamber 160 during the crushing event. The hub type crushing head 210 delivers the crushing force to crush the aluminum cans 700 each work cycle, and therefore must be robust and able to withstand the maximum design force each crushing stroke of the invention 10, which in this case is ~170 lbs force at 100 psig supplied air pressure. It is the inventor's desire that the hub type crushing head 210 have a minimum 50,000 "crushed can" duty cycle and that it is replaceable.

As seen in FIGS. 1, 2, 4, 5D, 9, and 10, the ejection cylinder 300 provides the mechanism to eject the crushed aluminum cans 700 from the invention 10. The ejection cylinder 300 is a single acting, front nose mount pneumatic air cylinder. The ejection cylinder 300 includes the; ejection cylinder actuator piston 302, ejection cylinder actuator rod 304, ejection cylinder return spring 306, ejection cylinder vent hole 308, and a female NPT air/gas port. The ejection cylinder 300 and associated components are designed for a maintenance free life and are made from high quality materials that are designed to withstand the rigors and stresses of the invention 10. The ejection cylinder actuator rod 304 stroke length must be long enough to impact the crushed can and eject it from the crushing chamber 160. The ejection cylinder 300 is front nose mounted horizontally with a steel ejection cylinder mounting bracket 320 which is through wall mounted to the ejection cylinder mounting base 310 and the operating platform 600. The operating medium, air in this case is supplied to the ejection cylinder 300 via the female NPT port.

The ejection cylinder 300 operating cycle uses the same pneumatic principles as the crushing cylinder 200. As with the crushing cylinder 200, the size of the ejection cylinder actuator piston 302 determines the force that the actuator produces. The ejection cylinder actuator piston 302 is required to have a minimum of 0.20 sq. inch surface area to meet the design criteria of the invention 10 for the ejection process. The prototype invention 10 has a 0.40 sq. inch piston surface area and the extend force at 100 psi=40.0 lbs which is more than adequate for the ejection process.

As seen in FIGS. 1-3, 9, and 10, the prototype ejection ram 330 is a steel rod clevis locked in place with a Hex nut. The ejection ram 330 is mounted to the ejection cylinder actuator rod 304 threaded rod end and is the component that impacts the crushed aluminum cans 700 during the ejection process.

As seen in FIGS. 1-5D, a pneumatic manifold 400 is attached to the operating platform 600 via through wall mounting and is the air supply and distribution component of the invention 10. The prototype pneumatic manifold 400 is a rectangular, aluminum, 1000 psi pneumatic valve manifold. It has six stations; two air/gas supply female NPT inlets/outlets and four female NPT air/gas distribution outlets with standard hole spacing. Air is supplied to the pneumatic manifold 400 by the user via a standard steel quick disconnect pneumatic supply nipple 440 at the required pressure. Only two of the four female NPT air/gas distribution outlets on the pneumatic manifold 400 are used on the prototype. The remainder of the pneumatic manifold 400 outlets are plugged. Two male, straight, pneumatic push-to-connect fittings 410 are used to route air to the two 3-way solenoid control valves 540 and 545. The pneumatic manifold should be rated above the minimum pressure for the maximum possible air/gas supply pressure and should incorporate a safety relief valve if the maximum possible supply pressure is above the design pressure of the most limiting component of the invention 10. The pneumatic manifold is only required to have enough ports to support the invention 10.

As seen in FIGS. 1-4, all Pneumatic Fittings 410 and 420 used on the invention 10 are pneumatic push-to-connect, rotating or straight male fittings. The pneumatic fittings, rotating or straight, for each particular application were selected based on ensuring minimal bend stress and no kinking of the pneumatic poly tubing 430. Pneumatic push-to-connect fittings were selected for use on the prototype invention 10 due to the ease of connecting and disconnecting during the design phase of the invention 10. It is not the inventor's intention to limit future models solely to push to connect fittings.

Figure 2:
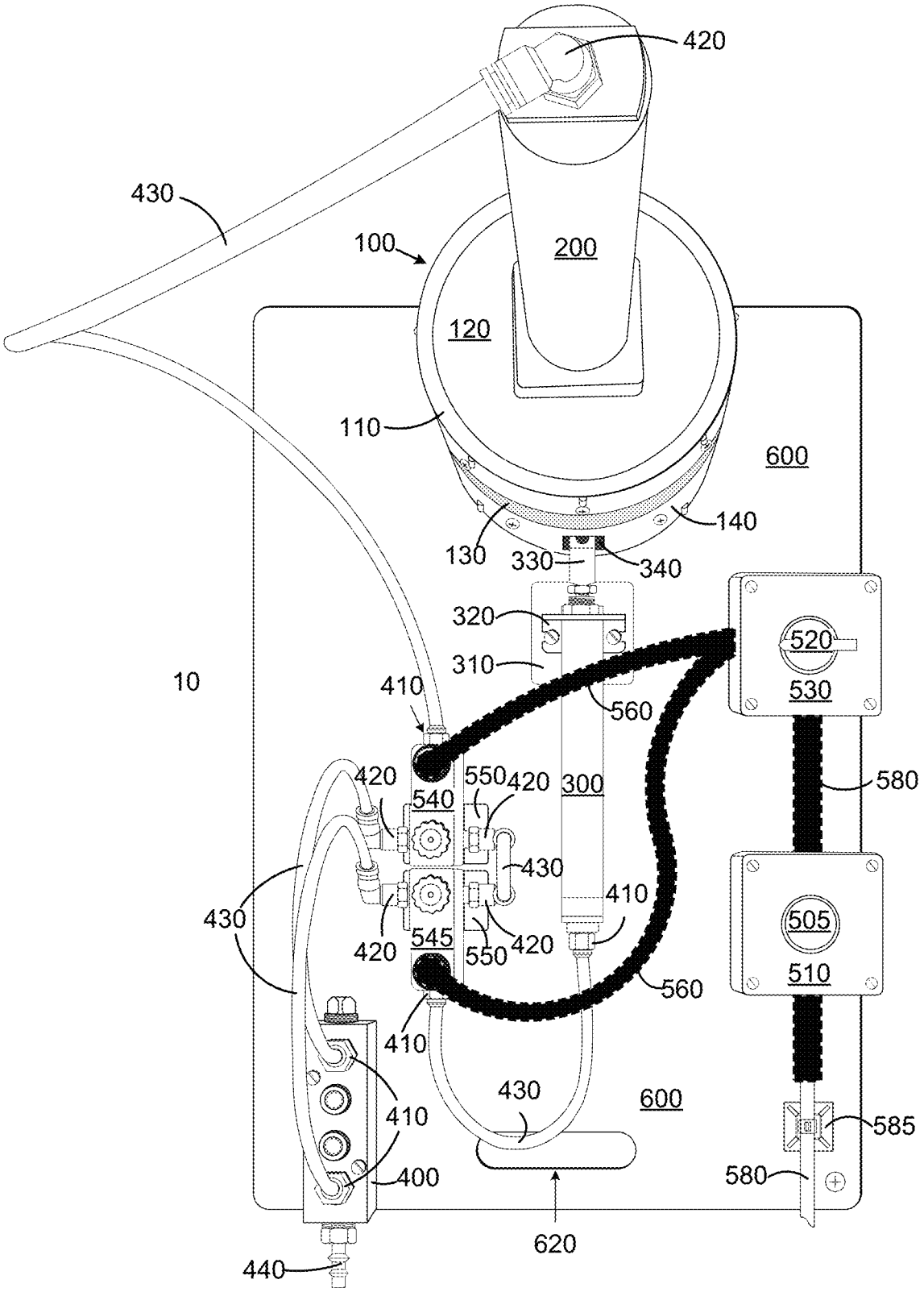
FIG. 2 is a top perspective view of an electro-pneumatic can crushing apparatus according to the present embodiment.

As seen in FIG. 2, five male, straight, pneumatic push-to-connect fittings 410 are used on the invention 10; two are used on the pneumatic manifold 400 to route the operating medium (air) to the two 3-way solenoid control valves 540 and 545, two are used on the two 3-way solenoid control valves 540 and 545 to route air to the crushing cylinder 200 and ejection cylinder 300, and one is used on the ejection cylinder 300 air supply port.

As seen in FIG. 2, five Male, Rotating Elbow, Push-to-Connect Pneumatic Fittings 420 are used on the invention 10; four are used on the two 3-way solenoid control valves 540 and 545, and one is used on the crushing cylinder 200 air supply port.

As seen in FIGS. 1-6B, five pieces of poly tubing 430 are used too route air/gas to the various components of the prototype invention 10. Any pressure rated tubing that can supply the appropriate air quantity to the operating components can be used. The tubing must be rated for pressures greater than the design working pressure of the invention 10. The poly tubing 430 for the prototype is rated at 150 psi air or water pressure. The poly tubing 430 is cut to length for each application to ensure that there is minimal bend stress and no kinking with the tubing. The five pieces of poly tubing 430 are connected via the push-to-connect fittings 410 and 420.

Figure 6B:
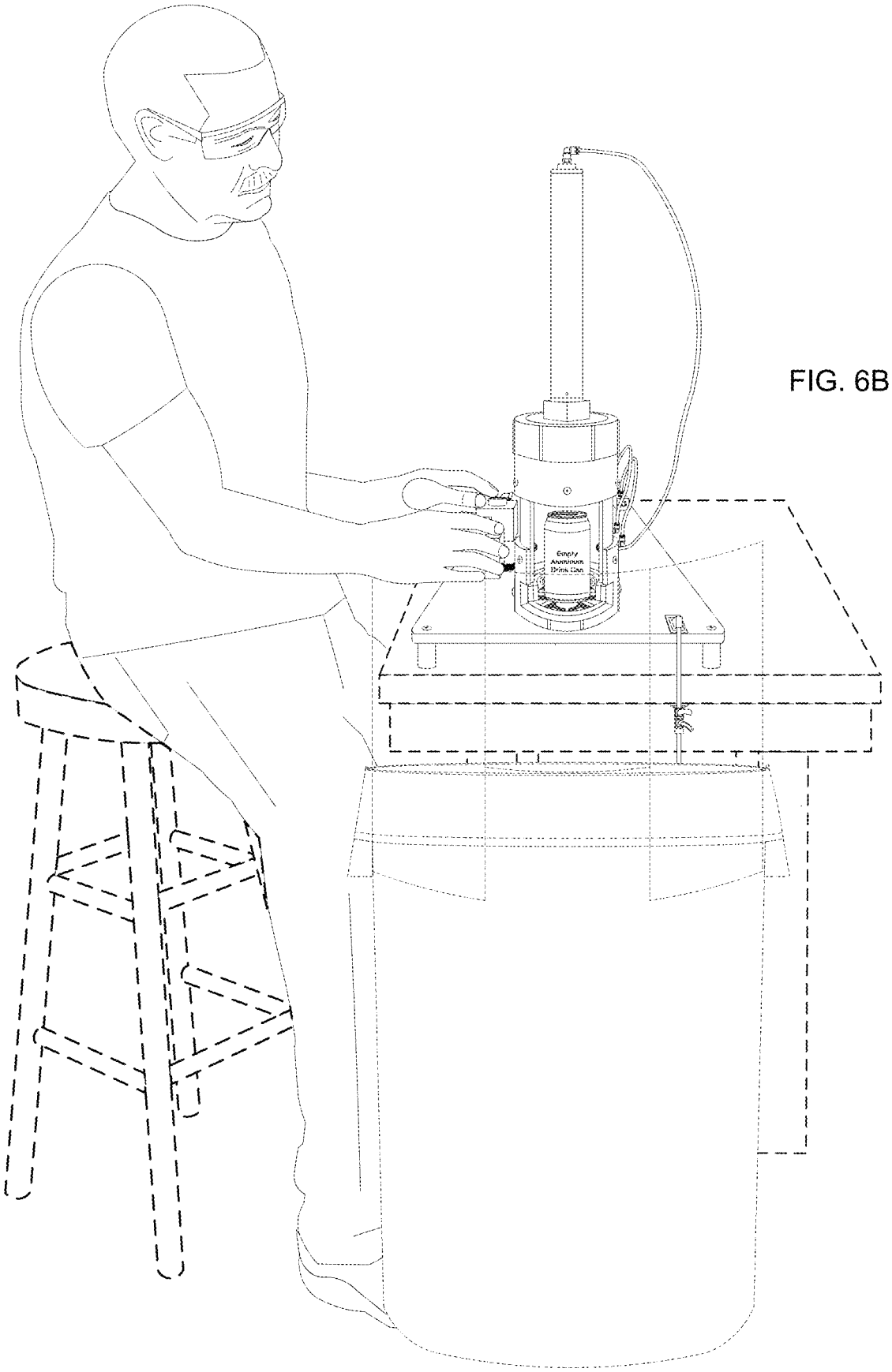
Figures 11A, 11B:
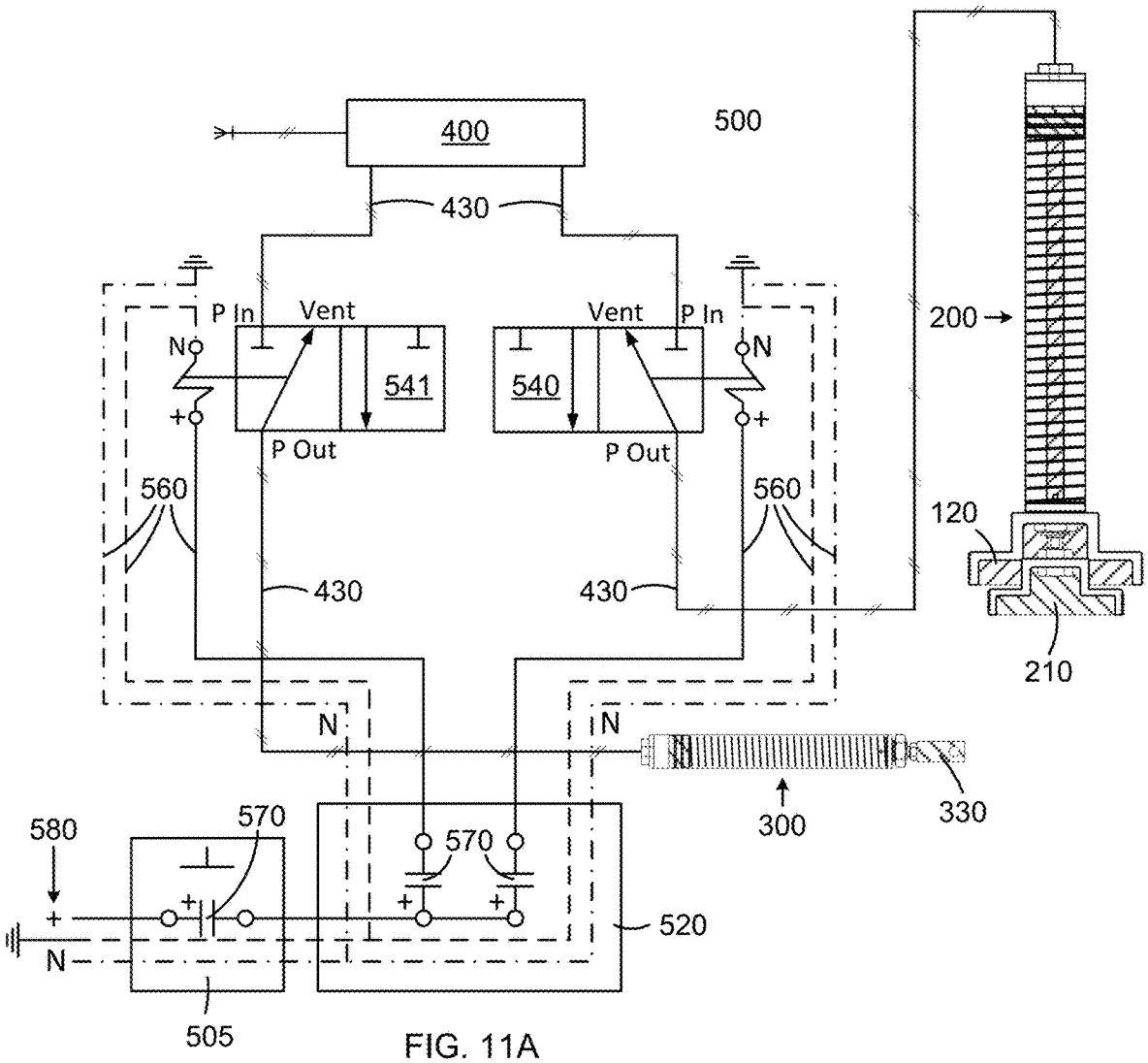
FIG. 11A is a schematic view of the electrical and pneumatic control circuits for an electro-pneumatic can crushing apparatus according to the present embodiment.
FIG. 11B shows the contact closure sequence for a 3-positon control switch for an electro-pneumatic can crushing apparatus according to the present embodiment.

As seen in FIGS. 1, and 2, the safety interlock push button 505 is mounted on the safety interlock push button enclosure 510. As seen in FIGS. 6B, and 11A, providing a safety interlock push button 505, physically requires two handed operation to electrically energize either of the two 3-way solenoid control valves 540 or 545, which ensures that the operator's hands are free from the operating components during operation. The safety interlock push button 510 for the prototype is a momentary plastic pushbutton with one normally open contactor attached. The safety interlock push button contactor should be rated for at least 200% of the maximum current rating of the two 3-way solenoid control valves 540 and 545. When the safety interlock push button 505 is in the non-depressed position no power is routed through the safety interlock push button's 505 normally open contact to the 3 position control switch 520. It is not the inventor's intention to limit future models solely to a push button type safety interlock switch.

Note: The invention 10 can be produced without the safety interlock push button 505, but for personnel protection the inventor recommends that consumer models of the invention 10 incorporate the safety interlock switch 505.

As seen in FIGS. 1, and 2, the 3 position control switch 520 is mounted on the control switch enclosure 530. As seen in FIGS. 11A, and 11B when the 3 position control switch 520 is operated in conjunction with the Safety Interlock Switch 505, 110 VAC electrical power is routed to one of the two 3-way solenoid control valves 540 or 545. The 3 position control switch 520 is a 3-position plastic selector switch with two normally open momentary contacts. The control switch 520 contactors 570 should be rated for at least 200% of the maximum current rating of the two 3-way solenoid control valves 540 and 545. When the 3 position control switch 520 is in the mid position no power is routed through the two normally open contacts to either of the two 3-way solenoid control valves 540 or 545.

As seen in FIGS. 1-6B, 11A, and 11B, the safety interlock push button enclosure 510 and control switch enclosure 530 provide the control interface for the invention 10. The safety interlock push button enclosure 510 and control switch enclosure 530 provides for power isolation, distribution and control. The enclosures are the mounting point for the safety interlock push button 505 and the 3 position control switch 520, and allow for the safe connection of the power and control wiring. The safety interlock push button enclosure 510 and control switch enclosure 530 for the prototype invention 10 are 600 VAC, wall mount, thermoplastic ABS, pushbutton/3 position control switch enclosures with a screw type cover. Any pushbutton enclosure that meets the requirements of safely providing power and control functions to the invention 10 is acceptable for use. The safety interlock push button enclosure 510 and control switch enclosure 530 are through wall mounted to the operating platform 600.

As seen in FIGS. 1, 2, 11A, and 11B, two 3-way solenoid control valves i.e. the crushing cylinder 3-way solenoid control valve 540 and the ejection cylinder 3-way solenoid control valve 545 are the components used to route air/gas at ~100 psig to the crushing cylinder 200 and the ejection cylinder 300. The prototype crushing cylinder 3-way solenoid control valve 540 and the ejection cylinder 3-way solenoid control valve 545 are 110 VAC 3-port (3-way) stackable poppet style, 2-position, normally closed, spring return, aluminum bodied solenoid valves. The two 3-way solenoid control valves 540 and 545 each have two FNPT inlets, one FNPT outlet, and one exhaust vent hole. The two 3-way solenoid control valves 540 and 545 for the prototype invention 10 each have a flow Coefficient (Cv) of 0.05 and are rated at 3.5 VA at 120 VAC and have 11 mm DIN style wiring plugs. Any appropriately rated solenoid valves that can perform the function of reliably routing air/gas to the working components of the invention 10 are acceptable for use. As seen in FIG. 11A, the two 3-way solenoid control valves 540 and 545 are normally de-energized with the 3-way valve blocking air to the crushing cylinder actuator piston 202 over piston area and the ejection cylinder actuator piston 302 over piston area. Also, the vent path from the crushing cylinder actuator piston 202 over piston area and ejection cylinder actuator piston 302 over piston areas are open allowing the crushing cylinder return spring 202 and ejection cylinder return spring 306 to retract the crushing cylinder actuator piston 202 and ejection cylinder actuator piston 302. Energizing either of two 3-way solenoid control valves 540 or 545 repositions the associated 3-way valve, closing the vent path and routing air to the associated cylinders over piston area allowing it to perform its intended function.

As seen in FIG. 11A, the control wiring 560 and contactors 570 in conjunction with the safety interlock push button 505 and 3 position control switch 520 provide the means to route 110 VAC control power to the two 3-way solenoid control valves 540 and 545 solenoids. The control wiring 560 for the prototype invention 10 is 14 gauge red, green & white, stranded copper wires rated for 600V. Any control wiring which meets the electrical ratings of the operating components is acceptable for use. The control wiring 560 is cut to length and ties the 3 position control switch contactors 570 outputs to the two 3-way solenoid control valves 540 and 545 solenoids input terminals. The control wiring 560 to each solenoid is wrapped in a UL listed plastic wire wrap. The contactors 570 for the prototype invention 10 are contained in contact blocks which are rated for standard 50/60 Hz AC up to 600 VAC. The contact ratings must be sufficient to meet the continuous operating and make/break current requirements of the invention 10. Each contact block contains one normally open contact.

As seen in FIGS. 1, 2, and 4-5D, the power cord 580 for the prototype invention 10, is not shown in full detail but is described here. The power cord 580 for the prototype invention 10, is a 15 foot, medium duty, braided copper 3 wire, grounded power cord. The power cord 580 wire ends are terminated and spliced inside the safety interlock push button enclosure 510. The power cord 580 from the safety interlock push button enclosure 510 to the control switch enclosure 530 is a medium duty, braided copper 3 wire, grounded, power cord which is terminated and spliced inside the two switch enclosures to supply 110 VAC control power to the invention 10. Any appropriately rated grounded power cord is acceptable for use. A 15 ft minimum length power cord is desirable for convenience.

As seen in FIG. 2, the prototype invention's two 3-way solenoid control valves 540 and 545 are mounted to individual solenoid control valve mounting brackets 550, with the associated individual mounting brackets through wall mounted to the operating platform 600. The remaining mounting hardware for the invention 10 is off-the-shelf appropriately sized and rated stainless steel and zinc alloy screws, nuts, bolts and washers. An adhesive wire retainer 585 is used to secure the power cord 580 to the operating platform which limits movement of the power cord 580 between the wire retainer and the safety interlock push button enclosure 510 to prevent stress on the electrical connections inside the safety interlock push button enclosure 510. Any appropriately rated mounting hardware is acceptable for use.

As seen in FIGS. 1-6B, the operating platform 600 is the mounting point and human interface point for all of the invention's components. The prototype operating platform 600 is a 12 inch, by 18 inch, by 0.375 inch, off-the-shelf nylon cutting board. The prototype operating platform 600 has four synthetic cork legs attached that support the platform and provide for vibration dampening. It is the inventor's intention that production models of the invention 10 would use rubber feet/legs in place of the synthetic cork legs. The legs provide a gap between the operating platform and the operating interface surface; typically a table, and allow for through wall attachment of the invention's components. Through wall mounting/attachment is an important aspect of the invention's robustness. The operating platform 600 can be made out of any material that is robust and has the properties to allow it to endure the stresses associated with the operation of the invention 10. Light materials are preferred.

User supplied air/gas at ~100 psig is the motive force of the invention 10. The air/gas source should be filtered and dried to increase the life span of the components. The inventor uses a standard shop/home air compressor which supplies filtered and dried compressed air at ~100 psig. However, any inert non-corrosive gas can be used as the motive force for the invention 10, for example; bottled compressed air, $N_2$, or Co2 gas regulated to 100 psig would be viable options. In the event that a high pressure supply is used and regulated to ~100 psig the inventor recommends adding a 125 psig safety relief valve to the pneumatic manifold 400 to protect the invention 10 from over pressurization in the event of a pressure regulator failure. The motive force source shall be supplied at a pressure less than the maximum design pressure of the components, but as high as possible to maximize the crushing capabilities of the crushing cylinder 200. Lower motive force (pressure) results in less crushing pressure: F=P×A.

DETAILED OPERATING DESCRIPTION

There are three main processes that are used to perform the invention's intended function; loading, crushing, and ejection/collection. Each step of the process is described in detail below.

Note: This description assumes that the invention 10 has qualified sources of power and air supplied to it and that the invention 10 is in the standby condition.

As shown in FIGS. 5A and 6A the invention 10 is loaded manually by physically placing an aluminum can 700, top up, into the crushing chamber 160. The aluminum can 700 is loaded so that it is sitting on the lower containment floor/crushing base 150 and is pressed into the crushing chamber 160 up against the position spacers 170.

Note: The invention 10 is capable of crushing cans that have no dents or imperfections, but an undented can takes the most force to crush. Therefore it is recommended, but not required, that while loading the can to be crushed to make a small indention in the middle area of the can. It only takes a small indention/imperfection to help in the crushing process.

With a can properly loaded the crushing process can be performed. As seen in FIGS. 1, 2, 5A-5C, 6A, 6B, 7, 8, 11A, and 11B, while standing or sitting in the operating position, perform the following: With your left hand, depress and hold the safety interlock push button 505 in the depressed position, and with your right hand turn and hold the 3 position control switch 520 to the RIGHT momentary positon. When the safety interlock push button 505 is depressed the normally open safety interlock push button 505 contactor 570 closes and routes power to the 3 position control switch 520. With the 3 position control switch 520 in the RIGHT positon, the RIGHT normally open contactor 570 attached to the 3 position control switch 520 closes, routing 110 VAC power to the crushing cylinder 3-way solenoid valve 540, solenoid. When the crushing cylinder 3-way solenoid valve 540, solenoid is energized it repositions the 3-way solenoid valve, which routes ~100 psig air to the crushing cylinder actuator piston 202 over piston area. The ~100 psig air causes the crushing cylinder actuator rod 204 and hub type crushing head 210 to stroke downward to the extended position. As the crushing cylinder actuator rod 204 and the hub type crushing head 210 stroke to the extended position the following three things happen: 1. Air is vented off the under piston area of the crushing cylinder actuator piston 202 via the under piston crushing cylinder vent hole 208. 2. The crushing cylinder return spring 206 is compressed. 3. The hub type crushing head 210 impacts the can with ~170 lbs force and crushes the can. The crushing cylinder actuator rod 204 and the hub type crushing head 210 stay in the extended position as long as adequate air is supplied to the crushing cylinder actuator piston 202 over piston area.

When the Crushing Process is complete, turn the 3 position control switch 520 to the MID stay-put positon and release the safety interlock push button 505. When the 3 position control switch 520 is placed in the MID stay-put positon or the safety interlock push button 505 is released, their associated contactors 570 return to the normally open position interrupting the 110 VAC power to the crushing cylinder 3-way solenoid valve 540, solenoid. When the crushing cylinder 3-way solenoid valve 540, solenoid is de-energized the crushing cylinder 3-way solenoid valve 540 repositions blocking air to the crushing cylinder 200 and venting the crushing cylinder actuator piston 202 over piston area to atmosphere. As the crushing cylinder actuator piston 202 over piston area is vented the crushing cylinder return spring 206 causes the crushing cylinder actuator rod 204 to stroke to the retracted position. As the crushing cylinder actuator rod 204 strokes to the retracted position air is drawn into the crushing cylinder actuator piston 202 under piston area via the crushing cylinder vent hole 208. The invention 10 is now ready for the ejection Process. Note: Occasionally more than one crushing stroke may be required to crush a can completely.

Once the can is crushed the ejection process is performed. As seen in FIGS. 1, 2, 5C, 5D, 6B, 9, 10, 11A, and 11B, while standing or sitting in the operating position perform the following: With your left hand, depress and hold the safety interlock push button 505 in the depressed position and with your right hand turn and HOLD the 3 position control switch 520 in the LEFT momentary positon. When the safety interlock push button 505 is depressed the normally open safety interlock push button 505 contactor 570 closes and routes power to the 3 position control switch 520. With the 3 position control switch 520 in the LEFT positon, the LEFT normally open contactor 570 attached to the 3 position control switch 520 closes, routing 110 VAC power to the ejection cylinder 3-way solenoid control valve 545, solenoid. When the ejection cylinder 3-way solenoid valve 545, solenoid is energized it repositions the 3-way solenoid valve, which routes ~100 psig air to the ejection cylinder actuator piston 302 over piston area. The ~100 psig air causes the ejection cylinder actuator rod 304 and the ejection ram 330 to stroke linearly to the extended position. As the ejection cylinder actuator rod 304 and ejection ram 330 stroke to the extended position the following three things happen: 1. Air is vented off the under piston area of the ejection cylinder actuator piston 302 via the under piston ejection cylinder vent hole 308. 2. The ejection cylinder return spring 306 is compressed. 3. The ejection ram 330 impacts the crushed can with ~40 lbs force and ejects the can from the crushing chamber 160. The ejection cylinder actuator rod 304 and ejection ram 330 stay in the extended position as long as adequate air is supplied to the ejection cylinder actuator piston 302 over piston area.

When the Ejection Process is complete, turn the 3 position control switch 520 to the MID stay-put positon and release the safety interlock push button 505. When the 3 position control switch 520 is placed in the MID stay-put positon or the safety interlock push button 505 is released, their associated contactors 570 return to the normally open position, interrupting the 110 VAC power to the ejection cylinder 3-way solenoid control valve 545, solenoid. When the ejection cylinder 3-way solenoid control valve 545, solenoid is de-energized the ejection cylinder 3-way solenoid control valve 545 repositions blocking air to the ejection cylinder 300 and venting the ejection cylinder actuator piston 302 over piston area to atmosphere. As the ejection cylinder actuator piston 302 over piston area is vented the ejection cylinder return spring 306 causes the ejection cylinder actuator rod 304 to stroke to the retracted position. As the ejection cylinder actuator rod 304 strokes to the retracted position air is drawn into the ejection cylinder actuator piston 302 under piston area via the ejection cylinder vent hole 308. The invention 10 is now ready for the next can crushing cycle. Note: Occasionally more than one ejection stroke may be required to eject a can.

This detailed description is not intended to limit the scope of materials or manufacturing processes used to produce future models. Since changes may be made to the presented apparatus without changing the scope or method of the invention as presented, it is intended that all matter in the above description, including drawings shall be consider illustrative and not in a limiting or constraining sense.

What is claimed is:

1. A can crushing apparatus for crushing typical small to medium sized aluminum drink cans, said apparatus comprising:

a containment structure with an integral crushing chamber and can positioning spacers sized to accept cans and contain said cans during the crushing event;

a pneumatic cylinder with a hub type crushing head that perform the crushing event;

a pneumatic ejection cylinder and a ram for ejecting crushed cans;

a pneumatic manifold, pneumatic fittings, pneumatic tubing and solenoid control valves for the distribution of air;

a safety interlock push button and a three position control switch with associated contactors for control of the apparatus;

a power source with a long power cord for control and operation of the apparatus; and, a shock absorbent operating platform with shock absorbent legs which allows for through wall mounting of components;

wherein said apparatus is portable due to its size, weight, and dimensions, and a handhold allows said apparatus to be easily moved.

2. The apparatus according to claim 1, wherein said containment structure is light weight, robust and designed to physically contain and standup to the force of the crushing event, said containment structure is cylindrical and includes a containment head, a upper containment, a containment barrel, a lower containment, a lower containment floor/crushing base, and said containment structure is through wall mounted to the operating platform via said lower containment floor/crushing base.

3. The apparatus according to claim 1, wherein said containment structure with said integral crushing chamber with said can positioning spacers are sized to accept up to ~20 oz typical aluminum drink cans for crushing.

4. The apparatus according to claim 1, wherein said containment structure has a combination loading and ejection opening on the front of the containment structure and an ejection ram access opening on the rear of the containment structure.

5. The apparatus according to claim 1, wherein said pneumatic crushing cylinder is attached to a containment head, a crushing cylinder actuator piston strokes vertically downward and produces the required crushing force at ~100 psig air pressure to crush aluminum cans, said pneumatic cylinder is of such design as to reduce air usage per stroke of said crushing cylinder actuator piston.

6. The apparatus according to claim 1, wherein, said hub type crushing head is attached to a crushing cylinder actuator rod, said hub type crushing head ensures said can is contained in said crushing chamber during the crushing event.

7. The apparatus according to claim 1, wherein said pneumatic ejection cylinder is through wall mounted to said operating platform and provides the mechanism to eject crushed cans from said crushing chamber, said ejection ram is attached to an ejection cylinder actuator rod and impacts the crushed can during said ejection process.

8. The apparatus according to claim 1, wherein said pneumatic manifold with a quick disconnect nipple provides a supply and distribution point for a user supplied air/gas source, said pneumatic fittings are designed to provide easy connection of the pneumatic tubing to the working components of the apparatus, said pneumatic tubing provides the mechanism for suppling air at the required pressure to the working components of said apparatus.

9. The apparatus according to claim 1, wherein said solenoid control valves are a plurality of 3-way solenoid control valves to provide the mechanisms for routing supplied air to said pneumatic cylinder and said pneumatic ejection cylinder for them to perform their intended functions, and said 3-way solenoid control valves are through wall mounted to said operating platform.

10. The apparatus according to claim 1, wherein said safety interlock push button and said three position three position control switch provide a control interface of said apparatus.

11. The apparatus according to claim 1, wherein said safety interlock push button and said three position control switch are utilized which requires two handed operation, said two handed operation of the apparatus prevents hand injuries by keeping the operator's hands free of the crushing chamber during the crushing event and ejection event.

12. The apparatus according to claim 1, wherein said power source utilizes; a plurality of electrical contactors, said safety interlock push button, said three position control switch and a control wiring to supply control power to said 3-way solenoid control valves.

13. The apparatus according to claim 1, wherein a plurality of control switch enclosures are utilized to mount said safety interlock push button, said three position control switch and said contactors.

14. The apparatus according to claim 1, wherein said power source utilizes a grounded power supply via a power cord which is sufficiently long to allow for convenient location of the apparatus during operation, said power cord would preferably be 15 ft or greater in length.

15. The apparatus according to claim 1, wherein said shock absorbent operating platform with said shock absorbent legs are utilized to dampen the forces produced during said crushing event, said shock absorbent legs providing enough lift to the operating platform to allow for through wall mounting of the components to said operating platform, said through wall mounting adds to the robustness of the apparatus.

* * * * *